US008578555B2

(12) United States Patent
Conrad

(10) Patent No.: US 8,578,555 B2
(45) Date of Patent: Nov. 12, 2013

(54) SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 656 days.

(21) Appl. No.: 12/722,705

(22) Filed: Mar. 12, 2010

(65) Prior Publication Data

US 2011/0219570 A1 Sep. 15, 2011

(51) Int. Cl.
*A47L 9/10* (2006.01)

(52) U.S. Cl.
USPC ..... 15/347; 15/327.7; 15/353

(58) Field of Classification Search
USPC ..... 15/327.7, 347, 353
See application file for complete search history.

(56) References Cited

U.S. PATENT DOCUMENTS

| | | | | |
|---|---|---|---|---|
| 3,002,215 | A | 10/1961 | MacFarland | |
| 3,870,486 | A | 3/1975 | Eriksson et al. | |
| 5,078,761 | A | 1/1992 | Dyson | |
| 8,146,201 | B2 * | 4/2012 | Conrad | 15/353 |
| 2008/0134460 | A1 | 6/2008 | Conrad | |
| 2008/0216282 | A1 | 9/2008 | Conrad | |
| 2009/0056060 | A1 | 3/2009 | Han et al. | |

FOREIGN PATENT DOCUMENTS

| | | | |
|---|---|---|---|
| CN | 201223346 | Y | 4/2009 |
| EP | 1674017 | A2 | 6/2006 |
| WO | 2009/026709 | A1 | 3/2009 |

OTHER PUBLICATIONS

Extended European Search Report received on the corresponding European Patent Application No. 11157642.7-2316, mailed on May 8, 2012.

The Office Action, issued on May 3, 2013, on the co-pending U.S. Appl. No. 13/039,146.

* cited by examiner

*Primary Examiner* — William Gilbert
*Assistant Examiner* — Patrick Maestri
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprises an air flow passage extending from a dirty air inlet to a clean air outlet. A suction motor is positioned in the air flow path. At least one cyclone is positioned in the air flow passage. An associated dirt collection chamber is exterior to the cyclone. The cyclone and the suction motor are positioned side by side and have generally parallel longitudinal axes. The dirt collection chamber may surround part of the suction motor. Alternately, or in addition, a pre-motor filter having an enhanced surface area may be provided by configuring the pre-motor filter to extend outwardly of the pre-motor filter, such as by overlie part of the cyclone or the dirt collection chamber.

12 Claims, 10 Drawing Sheets

SURFACE CLEANING APPARATUS

FIELD

The disclosure relates to surface cleaning apparatuses, such as vacuum cleaners. Particularly, the disclosure relates hand operable surface cleaning apparatuses.

INTRODUCTION

The following is not an admission that anything discussed below is prior art or part of the common general knowledge of persons skilled in the art.

Various constructions for surface cleaning apparatus such as vacuum cleaners are known. Currently, many surface cleaning apparatus are constructed using at least one cyclonic cleaning stage. The air is drawn into the vacuum cleaner through a dirty air inlet and conveyed to a cyclone inlet. The rotation of the air in the cyclone results in some of the particulate matter in the airflow stream being disentrained from the airflow stream. This material is then collected in a dirt collection chamber, which may be at the bottom of the cyclone or in a dirt collection chamber exterior to the cyclone chamber (see for example WO2009/026709 and U.S. Pat. No. 5,078,761). One or more additional cyclonic cleaning stages and/or filters may be positioned downstream from the cyclone.

SUMMARY

The following summary is provided to introduce the reader to the more detailed discussion to follow. The summary is not intended to limit or define the claims.

According to one aspect, a hand carriable surface cleaning apparatus is provided wherein the size, configuration and/or positioning of the dirt collection chamber may be varied so as to enable the dirt collection capacity of the unit to be increased without undesirably increasing the size of the unit or the size of the unit may be decreased without undesirably reducing the dirt collection capacity of the unit.

In accordance with this aspect, the dirt collection chamber for a cyclone is positioned to occupy at least part of the empty volume of a housing of the hand carriable surface cleaning apparatus. For example, a hand carriable surface cleaning apparatus may comprise a single first stage cyclone that has an associated dirt collection chamber. In addition, a suction motor is provided, typically downstream from the cyclone. Typically, the cyclone and the suction motor are generally cylindrical in shape. If both components are placed in an outer housing and oriented such their longitudinal axis are parallel, then a portion of the housing of the unit will be open. According to this aspect, the dirt collection chamber is configured to occupy at least part of this open space and preferably most of this space.

To provide a desirable outer appearance, an outer wall may be provided to encase the cyclone and the suction motor. Alternately, if part of the motor casing and/or the cyclone comprise part of the outer housing of the unit, an outer wall may be provided to bridge the suction motor and the cyclone. This part of the housing will typically be open and may be used as part or all of a dirt collection chamber.

A suction motor typically comprises a fan driven by a motor wherein the diameter of the fan is larger then the diameter of the motor. The wall of the motor casing is recessed inwardly from the wall of the fan casing. Therefore, there is an annular area between the outer wall of the motor casing and a projection of the location of the outer wall of the fan casing. The dirt collection chamber may alternately or in addition occupy some of all of this volume. For example, the dirt collection chamber may be constructed to comprise an annular chamber that is positioned to surround the motor casing.

It will be appreciated that the dirt collection chamber may also surround the cyclone. However, in a preferred embodiment, the dirt collection chamber surrounds only part of the cyclone. A portion of the cyclone is adjacent to the housing of the unit or forms part of the housing of the unit. Accordingly, the dirt collection chamber may surround about 75% or less of the cyclone and preferably about 50% or less of the cyclone. Accordingly, the size of the hand unit may be reduced without reducing the volume of the dirt collection chamber and, in some embodiments, the size of the dirt collection chamber may be increased.

A further advantage of this design is that the dirt collection chamber will not be circular in cross section. Accordingly, the tendency for the air in the dirt collection chamber to develop swirling or cyclone flow will be reduced, thereby inhibiting re-entrainment of dirt into the cyclone.

A further advantage is that the dirt collection capacity may be increased without increasing the size of the unit and, in some embodiments, the size of the unit may be reduced without greatly impacting the dirt capacity of the unit. Therefore, a hand operable surface cleaning apparatus, such as a hand vac, may be compact so as to be useable in small spaces. Further, as the unit is operated by being held in one hand, the weight of the unit may be reduced.

According to this aspect, a hand operable surface cleaning apparatus is provided. The surface cleaning apparatus comprises an air flow passage extending from a dirty air inlet to a clean air outlet. A suction motor is positioned in the air flow path. At least one cyclone is positioned in the air flow passage. An associated dirt collection chamber is exterior to the cyclone. The cyclone and the suction motor are positioned side by side and have generally parallel longitudinal axes. At least a portion of the dirt collection chamber is positioned between the cyclone and the suction motor.

At least a portion of the dirt collection chamber may surround at least a portion of the suction motor. The dirt collection chamber may surround the suction motor.

At least a portion of the dirt collection chamber may surround at least a portion of the cyclone. The dirt collection chamber may surround the cyclone.

The hand operable surface cleaning apparatus may further comprise a main housing, and the cyclone and the suction motor may be provided in the main housing, and the dirt collection chamber may be positioned in the housing.

The hand operable surface cleaning may further comprise a main housing, and the dirt collection chamber and the suction motor may be provided in the main housing.

The cyclone and the suction motor may each be positioned transverse to a forward direction of motion of the hand surface cleaning apparatus.

The cyclone may have a dirt outlet configured such that separated material travels from the dirt outlet to the dirt collection chamber. The dirt outlet may comprise an opening in a sidewall of the cyclone.

According to another aspect, a surface cleaning apparatus is provided. The surface cleaning apparatus may comprise an air flow passage extending from a dirty air inlet to a clean air outlet. A suction motor is positioned in the air flow passage. At least one cyclone may be positioned in the air flow passage, and may have an associated dirt collection chamber exterior to the cyclone. At least a portion of the dirt collection chamber surround at least a portion of the suction motor.

The dirt collection chamber may surround the suction motor. The suction motor may be positioned in a motor housing and dirt chamber may surround the motor housing.

The cyclone may be parallel to the suction motor. The dirt collection chamber may have a longitudinal axis, and the suction motor may have a longitudinal angle and the axes may be generally parallel.

The cyclone and the suction motor may be provided in a housing, and the dirt collection chamber may positioned in the housing with a portion of the dirt collection chamber positioned between the cyclone and the suction motor.

The dirt collection chamber and the suction motor may be provided in a housing and a portion of the dirt collection chamber may be positioned between the cyclone and the suction motor.

The surface cleaning apparatus may be a portable surface cleaning apparatus and the cyclone and the suction motor may each be positioned transverse to a forward direction of motion of the portable surface cleaning apparatus.

The cyclone may have a dirt outlet configured such that separated material travels from the dirt outlet to the dirt collection chamber.

The dirt outlet may comprise an opening in a sidewall of the cyclone.

According to another aspect, a hand surface cleaning apparatus is provided. The hand surface cleaning apparatus comprises an air flow passage extending from a dirty air inlet to a clean air outlet. A suction motor is positioned in the air flow path. At least one cyclone is positioned in the air flow path and has an associated dirt collection chamber exterior to the cyclone. A housing surrounds at least a portion of the suction motor and the cyclone, and has an open volume exterior of the cyclone and the suction motor. At least a portion of the dirt collection chamber is positioned in the open volume.

The cyclone may have an outer wall and a portion of the outer wall of the cyclone may form part of the housing.

The dirt collection chamber may have an outer wall and a portion of the outer wall of the dirt collection chamber may form part of the housing.

The hand surface cleaning apparatus may further comprise a suction motor housing having an outer wall. A portion of the outer wall of the suction motor housing may form part of the housing.

A portion of the dirt collection chamber may be positioned between the cyclone and the suction motor.

According to another aspect, a hand surface cleaning apparatus is provided that may be operable for an enhanced period of time without a significant reduction is air flow into the dirty air inlet. In accordance with this aspect, a pre-motor filter with enhanced surface area transverse to the direction of air flow is provided.

Typically, a hand surface cleaning apparatus such as a hand vac has a pre-motor filter and a post motor filter. The post motor filter may be a HEPA filter. In such a case, the air discharged from the clean air outlet of the unit may be comparable to that discharged from a full size vacuum cleaner. As the HEPA filter is used, the air flow through the unit will decrease and the suction provided by the unit will decrease. This can impact upon the cleanability achieved by the unit. To counter this, a larger suction motor may be provided. However, that would increase the hand weight of the unit. A pre-motor filter reduces the level of entrained dirt that will reach the HEPA filter. However, the filter will become clogged with use. Increasing the surface area of the upstream side of the pre-motor filter extends the lifetime of the pre-motor filter and may therefore enhance the life of a post motor filter.

The pre-motor filter may have an enhanced surface area of its upstream side by configuring the pre-motor filter to extend have a larger surface area then that of the suction motor inlet end. A pre-motor filter may be positioned in the suction motor casing and may therefore have a diameter that is about the same as the diameter of the fan of the suction motor. By configuring the pre-motor filter to overlie part of one or more additional components of the unit, the surface area of the upstream side is increased.

For example, a suction motor may be positioned beside a cyclone and extend in the same direction of the cyclone. Accordingly, one end of a cyclone may be adjacent the inlet end of the suction motor (e.g., positioned in about the same plane). The pre-motor filter (preferably a foam filter and more preferably a foam filter with a felt filter downstream thereof) may be configured to overlie part or all of the cyclone. Alternately, or in addition, the pre-motor filter may overlie part of the open volume between the suction motor and the cyclone. If the dirt collection chamber is positioned to occupy some of the open volume, then the pre-motor filter may alternately or in addition overlie part or all of the dirt collection chamber. Accordingly, a pre-motor filter with an enhanced surface area of the upstream side may be provided without substantially increasing the size of the unit.

According to this aspect, a hand surface cleaning apparatus is provided. The hand surface cleaning apparatus comprises an air flow passage extending from a dirty air inlet to a clean air outlet. A suction motor is positioned in the air flow path and has an inlet end and an outlet end. At least one cyclone is positioned in the air flow path and has an associated dirt collection chamber, a cyclone air inlet and a cyclone air outlet. A pre-motor filter is positioned downstream of the cyclone and upstream of the suction motor. The pre-motor filter has an upstream side and a downstream side. The pre-motor filter overlies at least a portion of the suction motor and the cyclone.

The cyclone and the suction motor may be positioned side by side and may have generally parallel longitudinal axes.

The pre-motor filter may overlie at least half of the suction motor and the cyclone. The pre-motor filter may overlie at least 75% of the suction motor and the cyclone.

The pre-motor filter may have a portion that is centered over the suction motor and a portion that overlies at least half of the cyclone.

Thee upstream side of the pre-motor filter may face the cyclone air outlet and an inlet duct of the suction motor may extend through the pre-motor filter to the downstream side of the pre-motor filter.

The cyclone air outlet may extend through the pre-motor filter to the upstream side of the pre-motor filter, and the inlet end of the suction motor may face the downstream side of the pre-motor filter.

The hand surface cleaning apparatus may further comprising an openable door positioned at a side of the hand vacuum cleaner having the cyclone air outlet and the inlet end of the suction motor. The upstream side of the pre-motor filter may be visible when the door is opened.

The pre-motor filter may be mounted to at least one of the cyclone and the suction motor and the pre-motor filter may remain in position when the door is opened.

The pre-motor filter may be spaced from the door and a chamber may be provided between the pre-motor filter and the door.

DRAWINGS

Reference is made in the detailed description to the accompanying drawings, in which.

DETAILED DESCRIPTION

Figure 1:
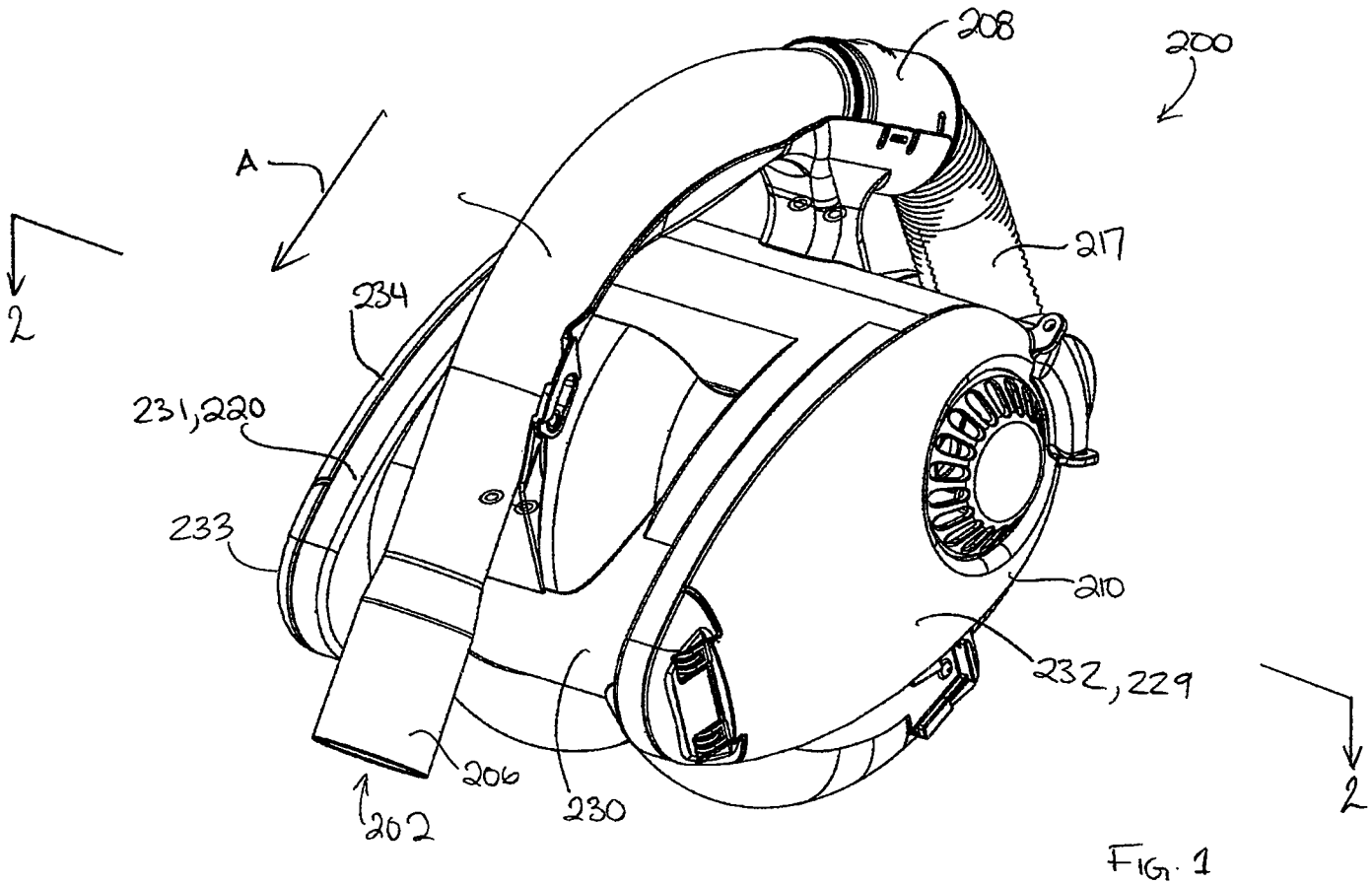
FIG. 1 is a perspective illustration of an embodiment of a surface cleaning apparatus.

Referring to FIG. 1, an embodiment of a surface cleaning apparatus 200 is shown. In this embodiment the surface cleaning apparatus 200 is a hand operable surface cleaning apparatus. The surface cleaning apparatus 200 is usable in a forward direction of motion, indicated by arrow A in FIG. 1.

Figure 2:
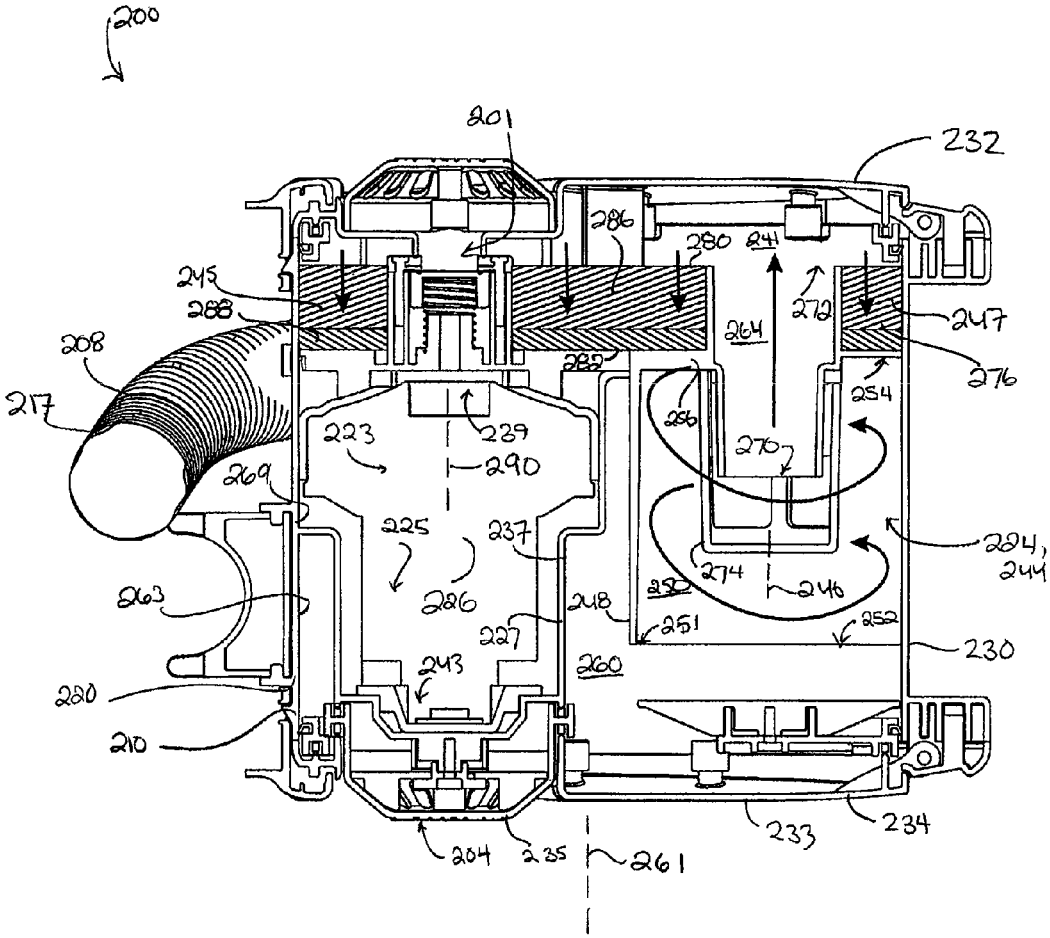
FIG. 2 is a cross section taken along line 2-2 in FIG. 1.

Referring to FIG. 2, the surface cleaning apparatus 200 has a dirty air inlet 202, a clean air outlet 204 (shown in FIG. 2), and an air flow passage extending therebetween. In the embodiment shown, the dirty air inlet 202 is provided in a nozzle 206. From the dirty air inlet 202, the airflow passage extends through the nozzle 206, and through an air conduit 208, to a suction and filtration unit 210. The clean air outlet 204 is provided in the suction and filtration unit 110. In the embodiment shown, the air conduit 108 includes a wand 214, and a hose 217.

Referring now to FIGS. 1 and 2, the suction and filtration unit 210 includes a main housing 220. A filtration member 224 is provided in the main housing 220, and the filtration member 224 is positioned in the airflow passage downstream of the dirty air inlet 202, for removing particulate matter from air flowing through the airflow passage.

A suction motor 226 is also provided in the main housing 220, downstream of the filtration member 224, for drawing air through the airflow passage. The suction motor 226 may be any suitable type of suction motor. In the embodiment shown, the suction motor 226 includes a fan 223, and a motor 225.

In the embodiment shown, the filtration member 224 and suction motor 226 are positioned side-by-side. Further, the filtration member 224 extends along an axis 246, and the suction motor extends along an axis 290, and the axes 246, 290 are generally parallel. Further, the filtration member 224 and suction motor 226 are each positioned transverse to the forward direction of motion (indicated by arrow A in FIG. 1) of the hand surface cleaning apparatus 100.

Referring to FIG. 1, in the embodiment shown, the main housing 220 includes a central wall 230, a first side wall 232, and a second side wall 234. The first side wall 232 is pivotably mounted to the central wall 230, and serves as a first openable door 229. The second sidewall 234 has a first portion 233 adjacent the filtration member 224, and a second portion 235 adjacent the suction motor 226. The second sidewall 234 is pivotably mounted to the central wall 230, and serves as a second openable door 231. Further, the second portion 235 is removable from the first portion 233.

Referring to FIG. 2, an interior wall 237 extends within the main housing 220 to separate the suction motor 226 from the filtration member 224, so that fluid communication between the filtration member 224 and the suction motor 226 may generally only occur between a filtration member air outlet 264, and a suction motor air inlet end 239, as will be described in further detail hereinbelow. The interior wall 237 generally surrounds the suction motor 226 to form a motor housing 227, and is integral with the central wall 230, so that a portion 269 of the motor housing 227 forms part of the housing 220.

Referring to FIG. 2, in the embodiment shown, the filtration member 224 is a cyclone 244. In alternate embodiments, the filtration member 224 may be, for example, a filter, such as a filter bag or a foam filter. In further alternate embodiments, the filtration member 224 may include a plurality of cyclones, or a plurality of cyclonic stages.

The cyclone 244 may be of any suitable configuration. The cyclone 244 includes a cyclone wall 248 (also referred to as an outer wall 248), which is integral with the central wall 230, and together with the central wall 230 defines a cyclone chamber 250. That is, a portion of the cyclone wall 248 forms part of the housing 220. A first end 251 of the cyclone wall 148, which is positioned towards the second sidewall 234, defines an opening 252, and an opposed second end 254 of the cyclone wall includes a second end wall 256. The cyclone wall 248 is positioned in the main housing 220 such that it is spaced from the second sidewall 234.

The open first end 252 of the cyclone serves as a dirt outlet for the cyclone 244. Material that is separated form air in the cyclone travels from the dirt outlet to an associated dirt collection chamber 260.

Figure 3:
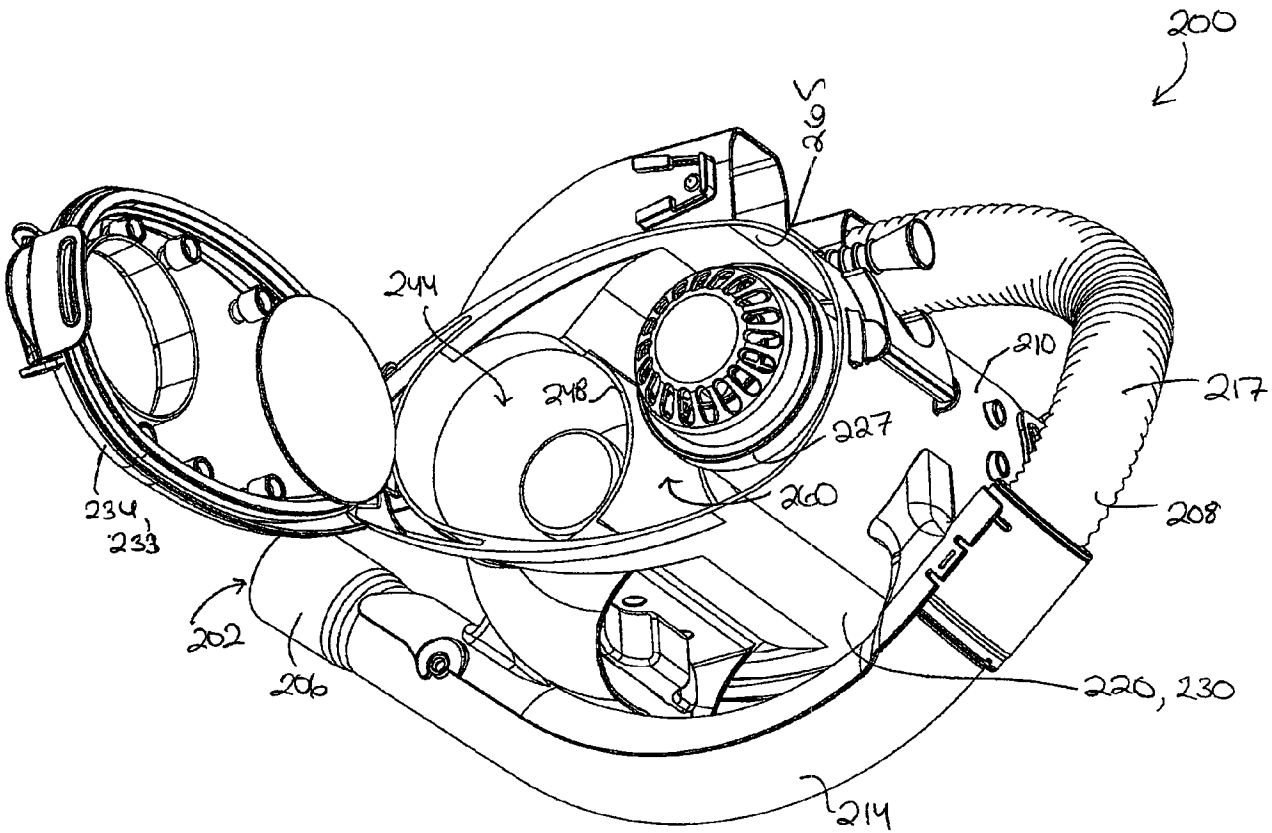
FIG. 3 is a perspective illustration of the surface cleaning apparatus of FIG. 1, showing a second openable door in an open configuration.

Referring to FIGS. 2 and 3, at least a portion of the dirt chamber 260 is preferably positioned in an open volume within the main housing 220. In the embodiment shown, the entire dirt chamber 260 is within an open volume within the main housing 220. The dirt collection chamber 260 is preferably within the main housing 220, exterior to the cyclone 244 and the suction motor 226. The dirt collection chamber extends along a longitudinal axis 261. The longitudinal axis 261 is preferably parallel to the suction motor axis 290.

Referring to FIGS. 2 and 3, at least a portion of the dirt collection chamber 260 is preferably positioned between the cyclone 244 and the suction motor 226. More preferably, at least a portion of the dirt collection chamber 260 surrounds at least a portion of the suction motor 226 and the suction motor housing 227. For example, the dirt collection chamber 260 may surround all of the suction motor 226, or only a portion of the suction motor 226, and/or all of the suction motor housing 227, or only a portion of the suction motor housing 227. As seen most clearly in FIG. 3, in the embodiment shown, the dirt collection chamber 260 fully surround the motor 225 of suction motor 226 and the portion suction motor housing 227 that houses the motor 225.

The dirt collection chamber 260 further preferably surrounds at least a portion of the cyclone. For example, in the embodiment shown, dirt collection chamber 260 extends around approximately one quarter of the cyclone 244. In alternate embodiments, the dirt collection chamber 260 may fully surround the cyclone 244.

Figure 4:
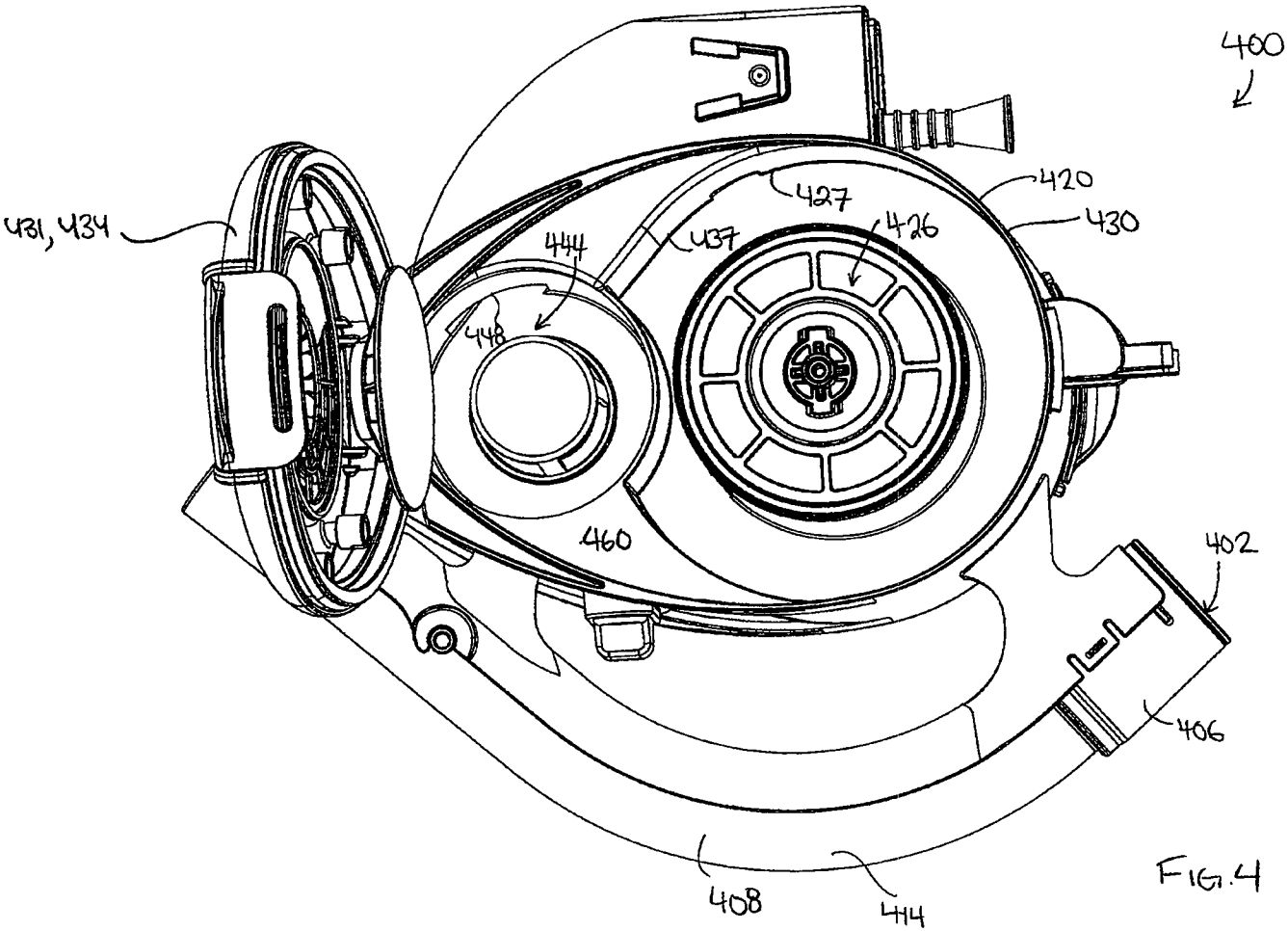
FIG. 4 is plan view of an alternate embodiment of a surface cleaning apparatus, showing a second openable door in an open configuration.
Figure 4B:
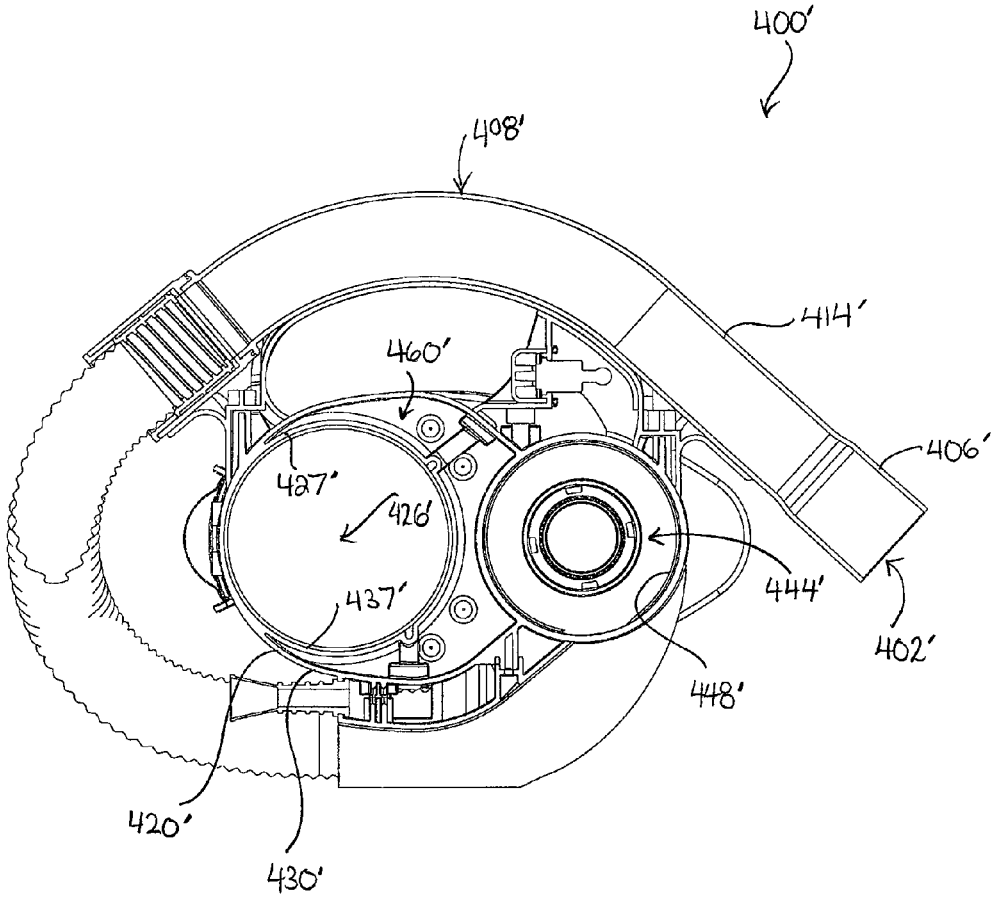
FIG. 4B is plan view of another alternate embodiment of a surface cleaning apparatus, showing a second openable door in an open configuration.

In an alternate embodiment of a surface cleaning apparatus 400 shown in FIG. 4, wherein like reference numerals are used to refer to like features as in FIGS. 1 to 3, with the first digit incremented to 4, the dirt collection chamber 460 partially surrounds the motor 425 of suction motor 426 and the portion suction motor housing 427 that houses the motor 425. Further, the dirt collection chamber 460 partially surrounds the cyclone 444. Particularly, the dirt collection chamber 460 surrounds approximately three quarters of the cyclone 444. In another alternate embodiment of a surface cleaning apparatus 400' shown in FIG. 5, wherein like reference numerals are used to refer to like features as in FIG. 4, with a prime (') after the reference number, similarly to the embodiment of FIG. 4, the dirt collection chamber 460' partially surrounds the motor 425' of suction motor 426' and the portion suction motor housing 427' that houses the motor 425'. Further, the dirt collection chamber 460' partially surrounds the cyclone 444'. Particularly, the dirt collection chamber 460' surrounds approximately one quarter of the cyclone 444'.

Referring to FIG. 3, the dirt collection chamber 260 has an outer wall 263, and a portion 265 of the outer wall 263 preferably forms part of the main housing 220.

The cyclone 244 further includes a cyclone air inlet (not shown), and a cyclone air outlet 264. The cyclone air inlet extends from a first end that is in communication with the hose 217 through the central wall 230 of the filtration member main housing 220, to a second end that is in communication with the cyclone chamber 250. The cyclone air outlet 264 extends along the axis 246, from a first end 270 that is positioned within the cyclone chamber 250, through the lower wall 156, and to a second end 272 (also referred to herein as an outlet 272 of the cyclone air outlet 264) that is in communication with a chamber 241 adjacent the first sidewall 232 of the suction and filtration unit 210. A screen 274 is preferably mounted over the first end 270 of the cyclone air outlet.

In use, air flows from the hose 217 into the cyclone chamber 250 through the cyclone air inlet. In the cyclone chamber 250, the air flows within the cyclone wall 248 in a cyclonic pattern, and particulate matter is separated from the air. The particulate matter exits the cyclone chamber 250 through the open first end 252, and settles in the dirt collection chamber 260. The air exits the cyclone chamber 250 through the cyclone air outlet 264, and enters the chamber 241

Figure 3A:
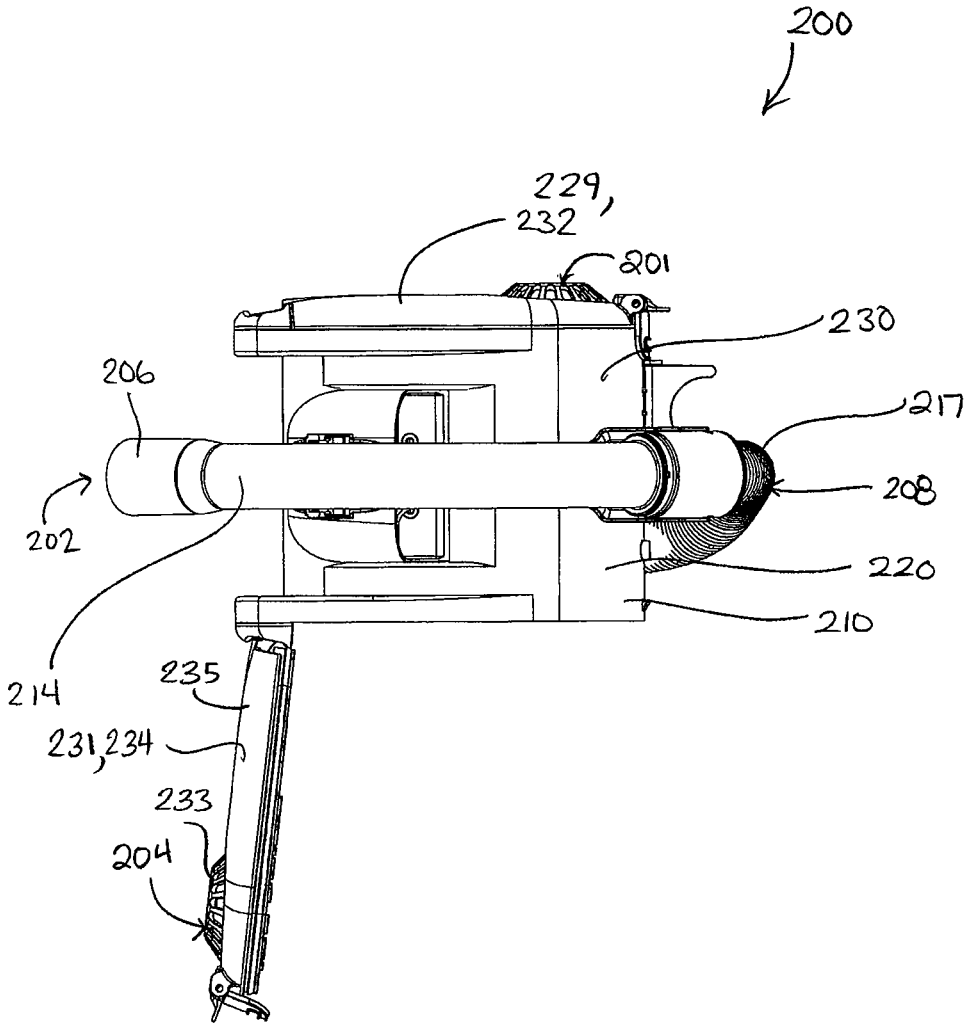
FIG. 3A is a side plan view of the surface cleaning apparatus of FIG. 1, showing a second openable door in an open configuration.

The dirt collection chamber 260 may be emptied in any suitable manner. Referring to FIG. 3A, in the embodiment shown, the second side wall 234 is pivotably openable, so that the dirt collection chamber 260 may be opened.

Referring still to FIG. 2, the surface cleaning apparatus includes a pre-motor filter 276 positioned downstream of the cyclone 244 and upstream of the suction motor 226. The pre-motor filter 276 is preferably housed in the chamber 241, is snugly received within the central wall 230, overlies the suction motor 226 and the cyclone 244, and spaced from the first openable door 229. In the embodiment shown, the pre-motor filter 276 overlies the all of the suction motor 226 and the cyclone 244. In alternate embodiments, the pre-motor filter may overlie only a portion of the suction motor 226 and the cyclone 244. Preferably, the pre-motor filter 276 overlies at least half of the suction motor 226 and the cyclone 244, and more preferably, at least 75% of the suction motor 226 and the cyclone 244. Most preferably, as shown, the pre-motor filter has a portion 245 that is centered over the suction motor 226 and a portion 247 that overlies at least half of the cyclone 226. In the embodiment shown, the portion 247 overlies all of the cyclone 226.

The pre-motor filter has an upstream side 280 that faces the first sidewall 232 of the main housing 220, and an opposed downstream side 282 that faces the second sidewall 234 of the main housing 220. The pre-motor filter 276 may be any suitable type of filter. Preferably, the pre-motor filter includes a foam layer 286 and a felt layer 288.

Referring still to FIG. 2, the cyclone air outlet 264 extends through the pre-motor filter 276, so that air exiting the pre-motor filter 276 is in contact with the upstream side 280 of the pre-motor filter 286.

The air then passes through the pre-motor filter 276, towards a suction motor inlet end 239 that faces the downstream side 282 of the pre-motor filter 276. From the suction motor inlet 239, the air passes towards a suction motor outlet end 243, and out of the clean air outlet 204.

Figure 3B:
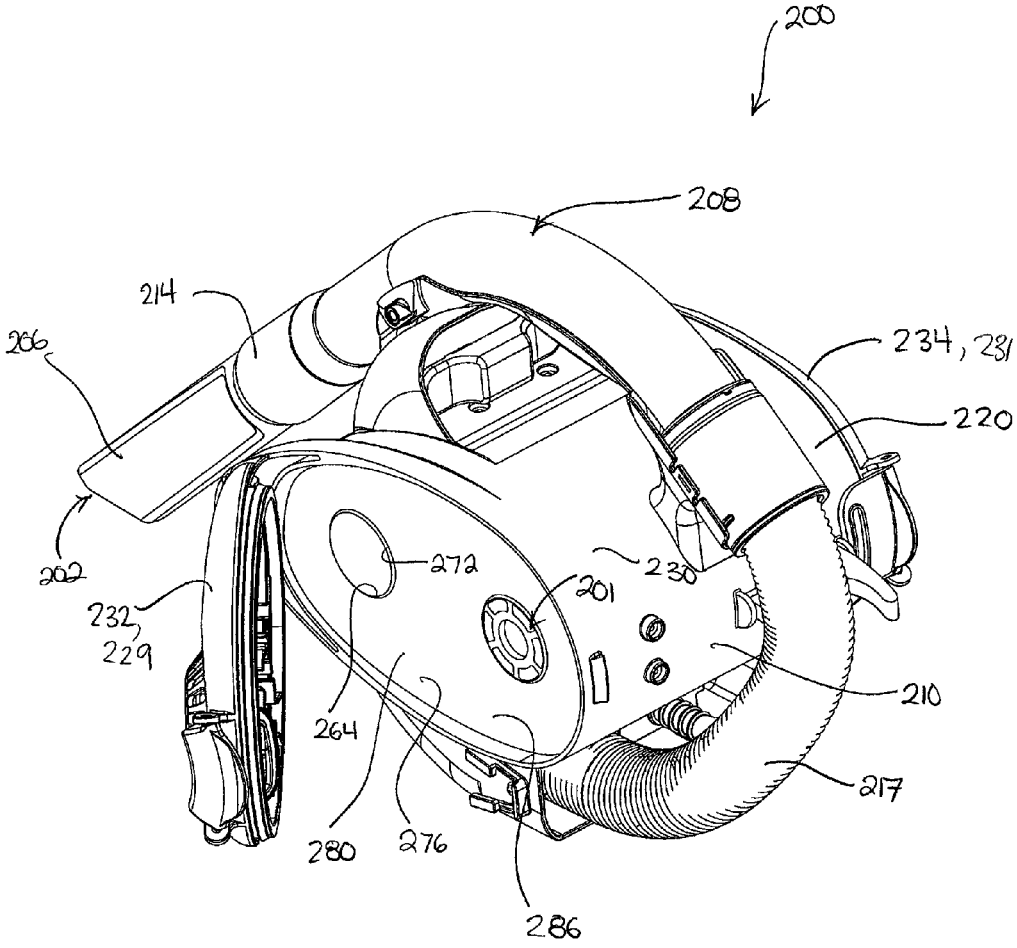
FIG. 3B is a perspective illustration of the surface cleaning apparatus of FIG. 1 showing a first openable door in an open configuration.

Preferably, as shown in FIG. 3B, when the first openable door 229 is open, the upstream side 280 of the pre-motor 276 is visible. By opening the openable door 229, the pre-motor filter may optionally be removed, replaced, or cleaned. Further, the pre-motor filter 276 is preferably mounted to at least one of the cyclone 244 and the suction motor 226, and the pre-motor filter 276 remains in position when the first openable door 229 is opened. For example, as shown, the pre-motor filter 276 is frictionally mounted to the cyclone air outlet 264.

Referring still to FIG. 2, the surface cleaning apparatus further includes a bleed valve 201. The bleed valve 201 allows air to flow from the suction motor inlet 239 to the clean air outlet 204 so that the suction motor 226 does not burn out if a clog occurs.

Figure 5:
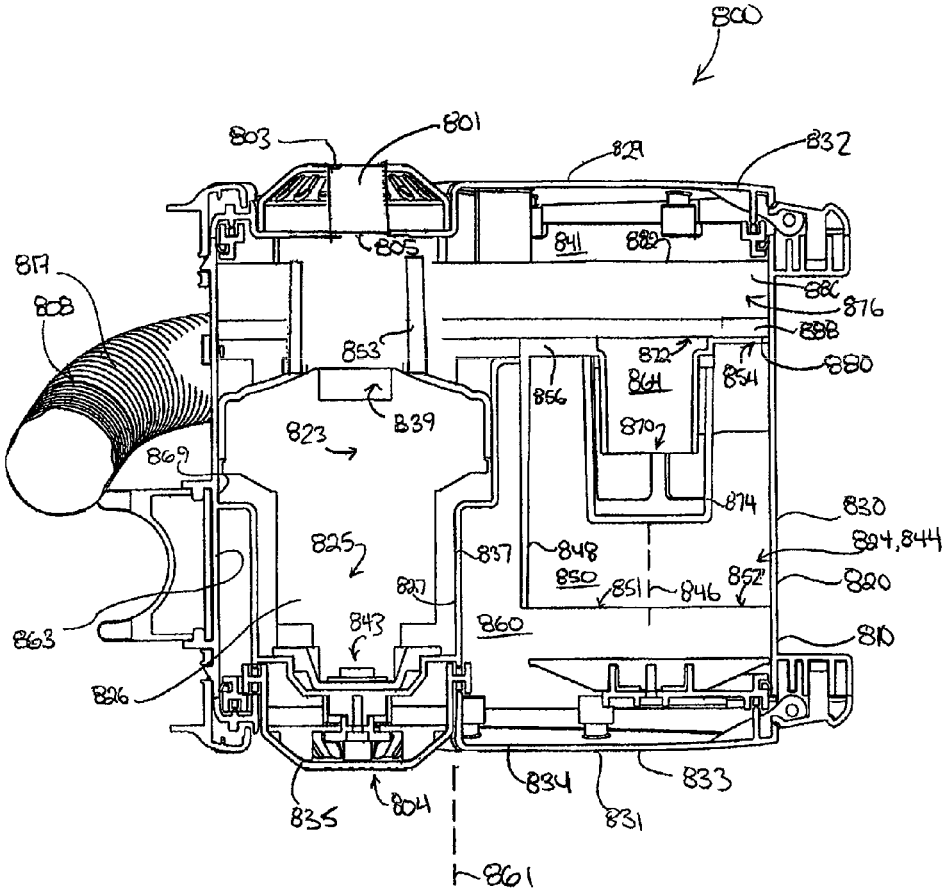
FIG. 5 is a cross section taken along the same line 2-2 through an alternate embodiment of a surface cleaning apparatus.

Referring to FIGS. 4 and 5, a further alternate surface cleaning apparatus 400 is shown. The surface cleaning apparatus is similar to the surface cleaning apparatus 200, and like numerals in the surface cleaning apparatus 800 will be used to describe like features as in the surface cleaning apparatus 200, with the first digit incremented to 8.

In the surface cleaning apparatus 800, the cyclone air outlet 864 does not extend through the pre-motor filter 876. The upstream side 880 of the pre-motor filter 876 faces towards the second sidewall 834 of the housing 820 and faces the cyclone air outlet 864, and the downstream side 882 of the pre-motor filter 876 faces the first sidewall 834. Air passes out of the second end 872 of the cyclone air outlet 864, through the pre-motor filter, and into the chamber 841.

The suction motor 826 has a suction motor inlet duct 853 that extends through the pre-motor filter 876 to the downstream side 882 of the pre-motor filter 876.

In this embodiment, the bleed valve 801 is provided in the openable door, and has an air outlet 805 that is within the chamber 841, so that it is in communication with the suction motor air inlet end 839.

When the openable door is open, the suction motor inlet 839 is visible, and the downstream side 882 of the pre-motor filter 876 is visible.

Figure 6A:
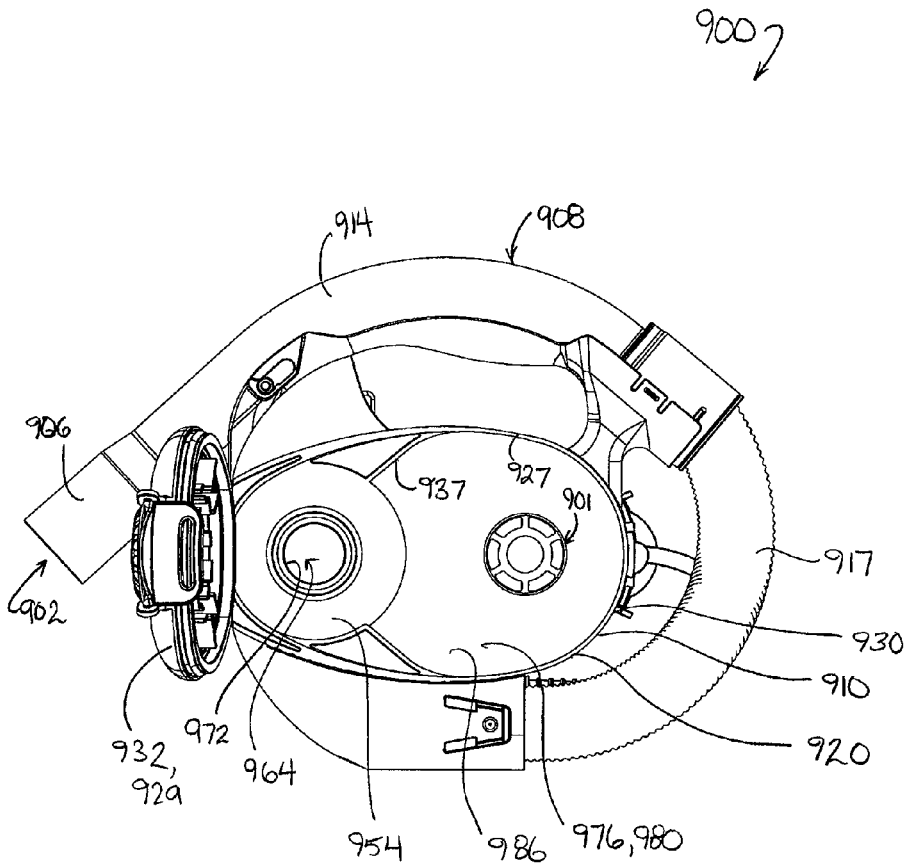
FIG. 6A is plan view of an alternate embodiment of a surface cleaning apparatus, showing a first openable door in an open configuration.
Figure 6B:
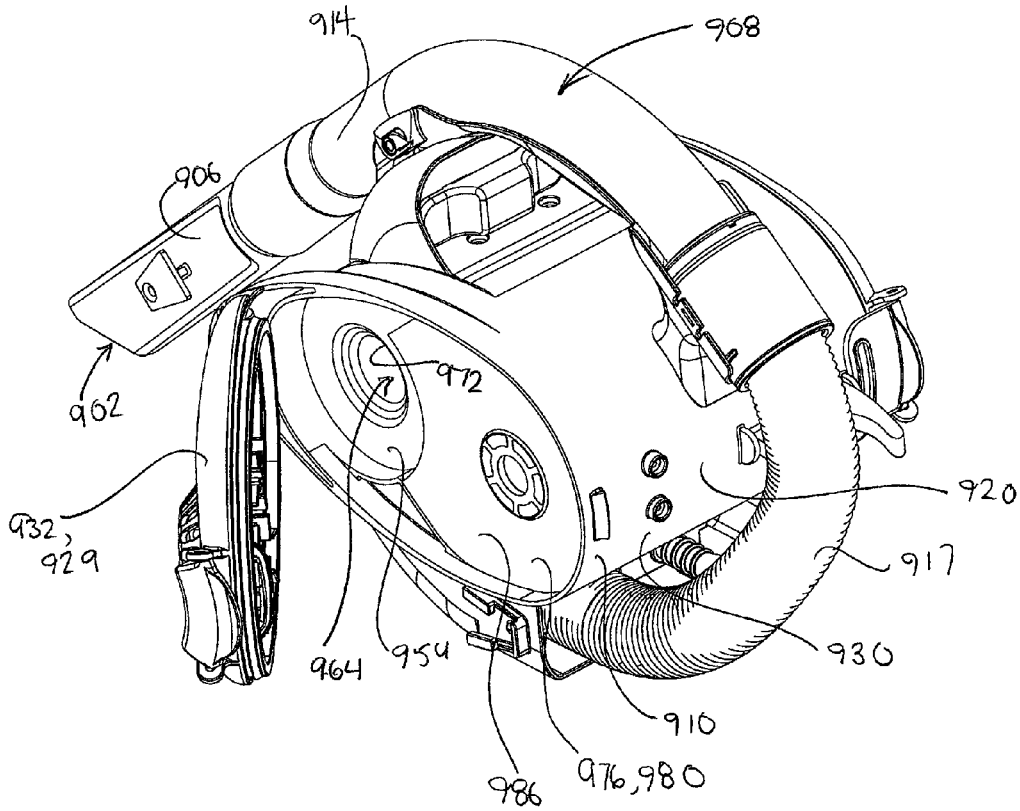
FIG. 6B is a perspective illustration of the surface cleaning apparatus of FIG. 6A.

Referring to FIGS. 6A and 6B, a further alternate surface cleaning apparatus 900 is shown. The surface cleaning apparatus is similar to the surface cleaning apparatus 200, and like numerals in the surface cleaning apparatus 900 will be used to describe like features as in the surface cleaning apparatus 200, with the first digit incremented to 9.

In the surface cleaning apparatus 900, the post motor filter 976 overlies only the motor (not shown) and the motor housing 927, and does not overlie the cyclone 944. The cyclone outlet 964 is in communication with the upstream side 980 of the post motor filter 976, which faces towards the first side 232 of the housing 220. The downstream side of the post motor filter 976 faces the motor inlet end (not shown) and the second side 234 of the housing 920. A bleed valve 901 extends through the post motor filter 976.

Various apparatuses or methods are described above to provide an example of each claimed invention. No example described above limits any claimed invention and any claimed invention may cover processes or apparatuses that are not described above. The claimed inventions are not limited to apparatuses or processes having all of the features of any one apparatus or process described above or to features common to multiple or all of the apparatuses described above.

The invention claimed is:

1. A surface cleaning apparatus comprising:

(a) an air flow passage extending from a dirty air inlet to a clean air outlet;

(b) a suction motor positioned in the air flow passage; and, (c) at least one cyclone positioned in the air flow passage and having an associated dirt collection chamber exterior to the cyclone, the dirt collection chamber comprises first and second portions that extend to either side of the suction motor whereby a portion of the suction motor is positioned between the first and second portions wherein at least a portion of the dirt collection chamber surrounds at least a portion of the suction motor.

2. The surface cleaning apparatus of claim 1 wherein the dirt collection chamber surrounds the suction motor.

3. The surface cleaning apparatus of claim 2 wherein the suction motor is positioned in a motor housing and dirt chamber surrounds the motor housing.

4. The surface cleaning apparatus of claim 1 wherein the cyclone is parallel to the suction motor.

5. The surface cleaning apparatus of claim 1 wherein the dirt collection chamber has a longitudinal axis and the suction motor has a longitudinal axis angle and the axes are generally parallel.

6. The surface cleaning apparatus of claim 1 wherein the cyclone and the suction motor are provided in a housing and the dirt collection chamber is positioned in the housing with a portion of the dirt collection chamber positioned between the cyclone and the suction motor.

7. The surface cleaning apparatus of claim 1 wherein the dirt collection chamber and the suction motor are provided in a housing and a portion of the dirt collection chamber is positioned between the cyclone and the suction motor.

8. The surface cleaning apparatus of claim 1 wherein the surface cleaning apparatus is a portable surface cleaning apparatus and the cyclone and the suction motor are each positioned transverse to a forward direction of motion of the portable surface cleaning apparatus.

9. The surface cleaning apparatus of claim 1 wherein the cyclone has a dirt outlet configured such that separated material travels from the dirt outlet to the dirt collection chamber.

10. The surface cleaning apparatus of claim 9 wherein the dirt outlet comprises an opening in a sidewall of the cyclone.

11. The surface cleaning apparatus of claim 1 wherein the dirt collection chamber surrounds only part of the suction motor.

12. The surface cleaning apparatus of claim 1 wherein the dirt collection chamber has a non-circular cross section.

* * * * *